US006371695B1

(12) United States Patent
Davenport, III et al.

(10) Patent No.: US 6,371,695 B1
(45) Date of Patent: Apr. 16, 2002

(54) OFFSHORE CAISSON HAVING UPPER AND LOWER SECTIONS SEPARATED BY A STRUCTURAL DIAPHRAGM AND METHOD OF INSTALLING THE SAME

(75) Inventors: George F. Davenport, III, Cypress; Karl H. Runge, Houston; J. Don Murff, Austin, all of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/408,903

(22) Filed: Sep. 29, 1999

Related U.S. Application Data

(60) Provisional application No. 60/107,403, filed on Nov. 6, 1998.

(51) Int. Cl.[7] ..... E02B 17/02

(52) U.S. Cl. ..... 405/204; 405/203; 405/211; 405/217

(58) Field of Search ..... 405/224, 204, 405/205, 195.1, 210, 217, 211, 216, 203, 249

(56) References Cited

U.S. PATENT DOCUMENTS

| | | | | |
|---|---|---|---|---|
| 3,645,103 A | | 2/1972 | Laffont | |
| 3,793,840 A | | 2/1974 | Mott et al. | |
| 3,815,374 A | * | 6/1974 | Hogan | 405/248 |

(List continued on next page.)

FOREIGN PATENT DOCUMENTS

CA 2025417 9/1990

OTHER PUBLICATIONS

Gijzel, T.G; Thomson, R.A.A.; and Athmer, J.B.E.M. "Installation of the Mobile Arctic Caisson Molikpaq," 17th Annual Offshore Technology Conference, Houston, Texas (May 6–9, 1985), Paper No. OTC 4942, pp. 389–397.

Masterson, D.M.; Bruce, J.C.; Sisodiya, R.; and Maddock, W. "Beaufort Sea Exploration: Past and Future," 23rd Annual Offshore Technology Conference, Houston, Texas (May 6–9, 1991), Paper No. OTC 6530, pp. 9–25.

Masonheimer, R.A.; Deily, F.H.; and Knorr, G.D. "A Review of CIDS First–Year Operations," 18th Annual Offshore Technology Conference, Houston, Texas (May 5–8, 1986), Paper No. OTC 5288, pp. 555–564.

Fitzpatrick, J. and Stenning, D.G. "Design and Construction of Tarsiut Island in the Canadian Beaufort Sea," 15th Annual Offshore Technology Conference, Houston, Texas (May 2–5, 1983), Paper No. OTC 4517, pp. 51–60.

Phillips, G.W. and Chen, A.C.T. "CIDS Completion and Mobilization to the Antares Site,"18th Annual Offshore Technology Conference, Houston, Texas (May 5–8, 1986), Paper No. OTC 5289, pp. 565–574.

Hnatiuk, J. and Felzien, E.E. "Molikpaq: An Integrated Mobile Arctic Drilling Caisson," 17th Annual Offshore Technology Conference, Houston, Texas (May 6–9, 1985), Paper No. OTC 4940, pp. 373–381.

(List continued on next page.)

*Primary Examiner*—H. Shackelford
*Assistant Examiner*—Sunil Singh
(74) *Attorney, Agent, or Firm*—Kelly A. Morgan; Gary P. Katz

(57) ABSTRACT

An offshore structure which is resistant to wave, earthquake and ice loads and can be quickly installed and abandoned in response to changing environmental conditions includes a caisson having an upper section and a lower foundation section which are separated by a structural diaphragm. When installed, the lower foundation section extends downwardly a distance from the seafloor to provide sufficient lateral and vertical soil resistance to resist lateral and vertical loads on the structure. The upper section is adapted to support a deck structure. The structural diaphragm is adapted to rest on the seafloor when an offshore structure has been fully installed to enhance the lateral and vertical load carrying capacity of the offshore structure. During installation, the structural diaphragm and a pump are used to form suction in the lower foundation section, thus enhancing the penetration of the lower foundation section into the seafloor.

26 Claims, 2 Drawing Sheets

U.S. PATENT DOCUMENTS

| | | | | | |
|---|---|---|---|---|---|
| 3,928,982 | A | * | 12/1975 | Lacroix | 405/210 X |
| 3,952,527 | A | * | 4/1976 | Vinieratos et al. | 405/217 |
| 4,048,943 | A | | 9/1977 | Gerwick, Jr. | 114/256 |
| 4,109,476 | A | | 8/1978 | Gracia | |
| 4,187,039 | A | | 2/1980 | Jahns et al. | 405/217 |
| 4,318,641 | A | | 3/1982 | Hogervorst | 405/224 |
| 4,425,055 | A | * | 1/1984 | Tiedemann | 405/204 X |
| 4,504,172 | A | | 3/1985 | Clinton et al. | 405/217 |
| 4,523,879 | A | | 6/1985 | Finucane et al. | 405/217 |
| 4,602,895 | A | * | 7/1986 | Wilkman et al. | 405/211 |
| 4,648,751 | A | | 3/1987 | Coleman | 405/209 |
| 4,648,752 | A | | 3/1987 | Guy et al. | 405/217 |
| 4,696,601 | A | | 9/1987 | Davenport | 405/202 |
| 4,733,993 | A | * | 3/1988 | Andreasson | 405/195.1 X |
| 4,749,309 | A | * | 6/1988 | Olsen | 405/204 |
| 4,784,526 | A | * | 11/1988 | Turner | 405/217 X |
| 5,186,581 | A | | 2/1993 | Ngoc et al. | 405/217 |
| 5,292,207 | A | | 3/1994 | Scott | 415/217 |
| 5,316,413 | A | * | 5/1994 | Sisodiya et al. | 405/217 |
| 5,951,207 | A | * | 9/1999 | Chen | 405/249 X |

OTHER PUBLICATIONS

Agerton, D. J. "Construction of an Arctic Offshore Gravel Island in 39 ft of Water During Winter and Summer," 15the Annual Offshore Technology Conference, Houston, Texas (May 2–5, 1983), Paper No. OTC 4548, pp. 309–316.

Galloway, D.E; Scher, R.L; and Prodanovic, A. "The Construction of Man–Made Drilling Islands and Sheetpile Enclosed Drillsites in the Alaskan Beaufort Sea," 14th Annual Offshore Technology Conference, Houston, Texas (May 3–6, 1982), Paper No. OTC 4335, pp. 437–447.

"*How the Arctic's top field will be developed*," Offshore Engineer, (Jan. 1987) pp. 47–48.

Hakala, R.; Joensuu, A.; Eranti, E.; and Gowda, S.S. "Analysis of Ice Forces on Caisson–Type Arctic Platform," 18the Annual Offshore Technology Conference, Houston, Texas (May 5–8, 1986), Paper No. OTC 5130, pp. 413–418.

Hicks, M.A. and Smith, I.M. "Class A prediction of Arctic caisson performance," *Geotechnqiue*, 38, No. 4, (1988), pp. 589–612.

McIntosh, I.; Birarda, G.; and Jonasson, W.B. "Caisson wellheads allow for future use of offshore exploration wells," *Journal of Canadian Petroleum Technology*, Montreal, Canada (Jan.–Feb. 1987), pp. 81–85.

* cited by examiner

OFFSHORE CAISSON HAVING UPPER AND LOWER SECTIONS SEPARATED BY A STRUCTURAL DIAPHRAGM AND METHOD OF INSTALLING THE SAME

Tails application claims the benefit of U.S. Provisional Application No. 60/107,403 filed Nov. 6, 1998.

FIELD OF THE INVENTION

This invention generally relates to offshore structures for use in severe storm, earthquake and arctic environments and more particularly to structures which are resistant to storm, earthquake and ice loads and can be used for year-round operations.

BACKGROUND OF THE INVENTION

Exploration and production of hydrocarbon reserves in arctic offshore regions present unique challenges due to the heavy ice cover environment. In these arctic regions, large moving bodies of ice can damage offshore structures such as drilling barges, offshore platforms and underwater pipelines. The ice environment not only presents technical challenges with respect to the design of arctic structures, but can also lead to a very short—often 3 months or less—drilling season, and in some areas the early onset of severe storms by mid-October can threaten to further shorten the drilling season.

Encroaching ice can pose a threat to drill ships or existing offshore structures and can cause interruption or abandonment of drilling operations during the short open water period of summer. Ice loads usually govern the design of structures and operations in these arctic environments because they arc likely the most significant loads an offshore structure or operation will face. Thus the ice environment dictates many decisions regarding offshore operations and cost feasibility. As described further below, the oil and gas industry has searched for ways to economically explore for and produce hydrocarbons in this environment. Many of the current methods for overcoming these ice environment problems arc expensive, limited to applications in shallow waters or arc not designed to be used in year-round operations.

One approach of oil exploitation in the ice environment is through the use of artificial islands as drilling and production platforms. Artificial islands are particularly well suited for shallow, near-shore or protected waters. These artificial islands are constructed of sand, gravel or dredged seabed filler material and are designed to resist the ice forces and minimize the erosion effects of summer storms. Drilling rigs and equipment can be brought to the site either by helicopter or trucking over the ice during early winter or by barges during summer. These artificial islands can be cost-competitive with other systems when there is ease of access from land, a suitable filler material is available, and stable ice conditions exist. The volume of filler material required for such an island depends on the work area, type of slope protection required and the water depth. Generally, use of these islands is economically limited to relatively shallow waters or areas with abundant filler material.

For operations in either deeper water s or m ore exposed areas, the volumes of filler material required to construct artificial islands becomes excessive, and thus much more expensive, due to (a) larger ice loads and (b) the natural slopes of the filler material (1:3 for (gravel, 1:12 for sand or silt). As a result, various caisson retained island concepts have been used in deeper waters. Tarsuit and Esso's Caisson Retained Island are examples of such retained islands. These concepts recognize that, in deeper waters, caissons can substantially reduce island fill requirements. Generally, these concepts use steel or concrete caissons, which provide much steeper slopes than a natural filler material, to form the outer perimeter of the island. The caissons are installed as single or multiple units either on the sea bottom or on a submerged berm, and the island is then formed by filling the core with dredged or other filler material. The caissons therefore reduce the amount of fill volumes required to construct the artificial island and can be used in areas where filler material is not readily available.

For even more exposed offshore sites, ice dynamics and shortened open water periods dictate the use of such novel drilling systems as the Concrete Island Drilling System (CIDS), the Single Steel Drilling, Caisson (SSDC), and the Mobile Arctic Caisson (MAC). The CIDS is a concrete and steel mobile drilling structure which consists of a steel mud base, a central concrete brick positioned in the ice zone, and twin steel deck barges supported on the brick. The SSDC was constructed from a tanker, a segment of which was equipped with a double hull having concrete between the shells, and was ballasted onto a subsea sand berm. The MAC is a caisson which consists of a continuous steel ring on which sits a self—contained deck structure. The core is filled with sand to provide horizontal resistance, and the MAC is designed to sit on a submerged berm in depths over 70 feet, but can operate without a berm in depths ranging from 30–70 feet. These systems are generally large monolithic systems which are constructed and fully outfitted with drilling equipment in a temperate environment and then towed to the desired arctic location.

These systems (SSDC, CIDS, and MAC) have been successfully deployed for exploratory well drilling during the relatively short drilling, season in the Canadian and Alaskan Beaufort Sea. However. even these newer systems are still limited in their capabilities of addressing both greater water depths and extreme ice and wave loads. Because of their large size, these systems are subject to comparably large ice and wave loads, resulting in increased design and construction cost to address those loads. All three would have to be installed on man-made berms designed for the selected system's foundation in order to withstand year-round operations. These systems are limited by water depth because the construction of the subsea berms becomes very costly and time consuming as water depth increases. Also, the freeboard of the three systems actually built were specifically designed for the protected regions of the Beaufort Sea, and would be subjected to wave over-topping in unprotected environments. Extensive protective measures, such as wave deflectors, would have to be installed to protect certain regions of the deck from wave slamming and wave overtopping. As a consequence of these limitations, development of hydrocarbon reserves in certain arctic regions may be uneconomic using, these systems.

Other mechanisms for handling, ice loads have been proposed including various barrier-type mechanisms which are used to protect existing offshore structures. For example, U.S. Pat. No. 4,523,879 (Finucane et al.) discloses a method for constructing spray ice barriers to protect offshore structures in a frigid body of water from mobile ice, waves and currents. U.S. Pat. No. 4,504,172 (Clinton et al.) discloses a caisson shield consisting of an essentially annular concrete structure which encircles at least the submerged support section of an offshore production platform. U.S. Pat. No. 5,292,207 (Scott) discloses a submersible mobile gravity based caisson which can be used to protect existing semisubmersible mobile offshore drilling units and mobile offshore oil well production rigs which are ice crush sensitive. These protective devices are generally limited to use in shallow and/or calm waters. One limitation with spray ice barriers is that they are not feasible when the ice is very dynamic. Also, the use of such barriers is limited to relatively shallow waters to ensure that the spray ice will be firmly grounded—which is necessary to provide protection. The other protective barriers are extremely costly where the wave environment is severe: they attract significant wave loading, and the cost for marine operations to deliver and set the barriers is relatively high.

Various ice resistant offshore platform structures have also been proposed for operating in the harsh arctic environment. For example, U.S. Pat. No. 4,048,943 (Gerwvick, Jr.) discloses a floating caisson that can be actively heaved in the water to break-up encroaching ice. U.S. Pat. No. 3,793,840 (Mott et al.) discloses a mobile arctic drilling and production platform having a controllably buoyant foundation-like base to afford a firm footing at its lower end which normally rests on the ocean floor. A conical shell-like body extends upwardly from the base to provide a widespread footing for the platform in conjunction with the base. A caisson extends through the platform and is partially embedded in the substratum beneath the platform to assist the platform in absorbing and transmitting to the ocean bottom the lateral forces imposed on the structure and to protect wells during and after drilling operations. Conical structures, such as the two reference above can be useful in a severe and dynamic ice environment and can be designed for a wide range of water depths. However, they tend to become very expensive, and because of the large conical shape, it is often difficult to install the deck and have access to the stricture for resupply.

For the foregoing reasons, persons skilled in the offshore petroleum industry will readily understand the economic incentives for a low-cost drilling and production platform system that is capable of year-round operations in severe storm, earthquake and ice environments. It would be further advantageous if such systems could be of relatively small dimensions to minimize ice loads and material quantities, easy to construct, and quickly installed and abandoned in response to changing ice conditions. As described further below, the present invention provides a system capable of meeting these needs.

SUMMARY OF THE INVENTION

The foregoing disadvantages of the previously proposed techniques and structures are substantially eliminated through the various embodiments of the present invention. In one embodiment, the present invention generally comprises an offshore structure for use in an offshore arctic environment in which moving ice sheets and other dynamic masses of ice are present. The offshore structure includes a tubular caisson structure having a lower foundation section and an upper section which are separated by a structural diaphragm. The lower foundation section extends downwardly from the seafloor into the seabed a distance to provide sufficient lateral and vertical soil resistance to resist lateral and vertical loads on the offshore structure. The upper section extends upwardly from the seafloor to a point above the surface of the body of water and is adapted to support a deck structure on the upper end. The structural diaphragm is adapted to rest on the seafloor when the offshore structure has been fully installed to enhance the lateral and vertical load carrying capacity of the tubular caisson structure. In a preferred embodiment, there is a means for creating suction in the lower foundation section during installation to assist the caisson in penetrating into the seabed. When used in ice environments, the offshore structure may include an optional ice resistor.

BRIEF DESCRIPTION OF THE DRAWINGS

The present invention and its advantages will be better understood by referring to the following detailed description and the attached drawings in which.

The invention will be described in connection with its preferred embodiments. However, to the extent that the following detailed description is specific to a particular embodiment or a particular use of the invention, this is intended to be illustrative only, and is not to he construed as limiting the scope of the invention. On the contrary, it is intended to cover all alternatives, modifications, and equivalents that are included within the spirit and scope of the invention, as defined by the appended claims.

DETAILED DESCRIPTION OF THE PREFERRED EMBODIMENTS

Figure 1:
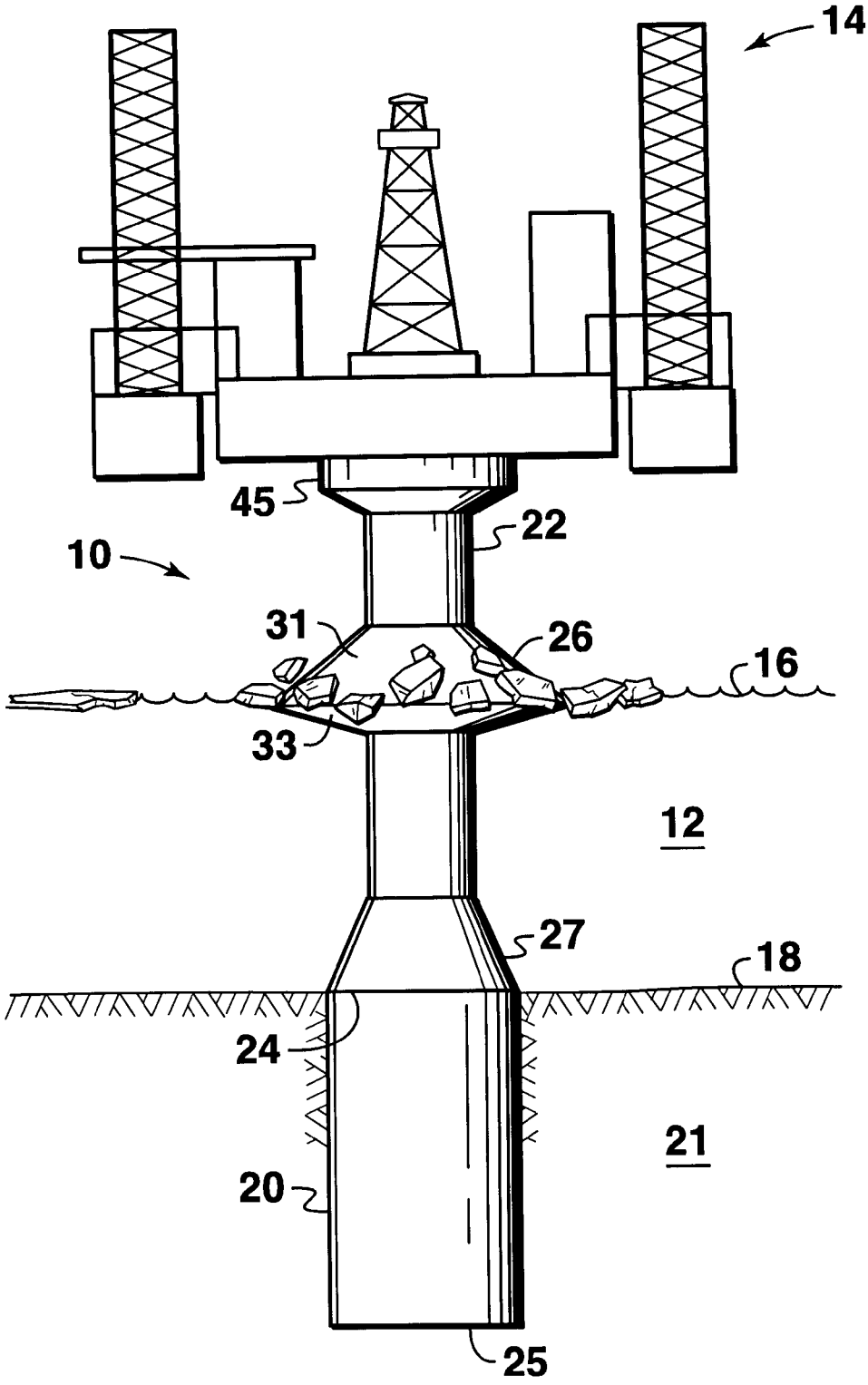
FIG. 1 is a schematic elevational view of an offshore structure in accordance with the present invention.

FIG. 1 schematically depicts an offshore structure 10 in accordance with the invention operating in a body of water 12. The offshore structure 10 is depicted in combination with an integrated deck and transport system 14 installed thereon. The integrated deck and transport system 14 is disclosed in co-pending patent application entitled "Deck Installation System for Offshore Structures" U.S. patent application Ser. No. 09/409,044 is fully incorporated herein by reference for purposes of U.S. patent practice. Generally, the offshore structure 10 comprises an upper section 22, with an optional ice resistor 26, a lower foundation section 20, and a structural diaphragm 24 separating the upper section 22 and the lower foundation section 20. Upper section 22 and lower foundation section 20 are connected by tapered transition section 27. The upper section 22 of offshore structure 10 may (if necessary to provide additional support for a deck or rig) also include a deck support section 45. Although described herein in connection with offshore arctic drilling operations this invention is not limited to supporting drilling rigs or for use in arctic operations. It can be suitable for any type of offshore operation, including without limitation operations in earthquake and severe storm environments.

Figure 2:
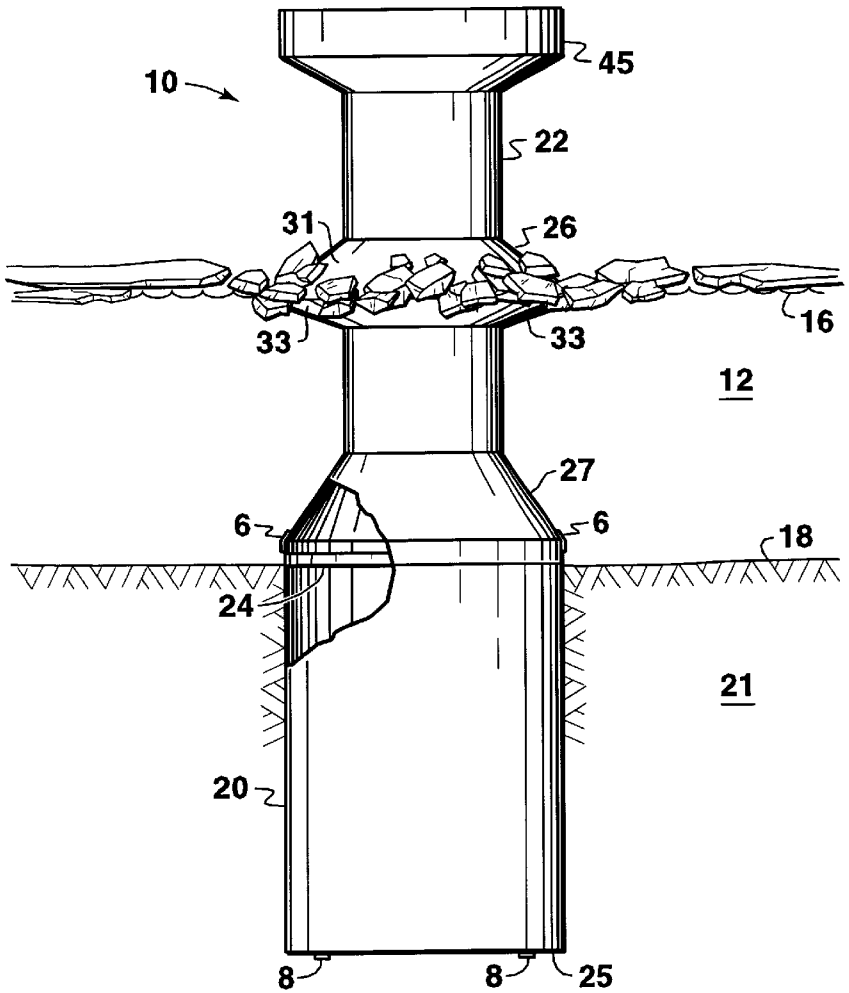
FIG. 2 is a schematic elevational view of an offshore structure in accordance with the present invention, without a deck structure installed thereon.

One embodiment of the offshore structure 10, without a drilling rig or production deck installed, is illustrated in FIG. 2. The offshore structure 10 comprises a offshore structure which is substantially hollow (with the exception of any necessary internal stiffening, piping and equipment). The offshore structure 10 is shown as substantially cylindrical but could be of different cross-section depending on the particular application. The offshore structure 10 has a lower foundation section 20 (which is open at one end 25) and an upper section 22 which are separated by a structural diaphragm 24. When installed, the lower foundation section 20 extends downwardly a distance from the seafloor 18 into the seabed 21 to provide sufficient lateral and vertical soil resistance to resist lateral and vertical loads on the offshore structure 10. The upper section 22 extends upwardly from the seafloor 18 to a point above the surface 16 of the body of water 12.

To ensure sufficient structural and foundation resistance against ice loading, the offshore structure 10 may need to be outfitted with an ice resistor. shown in FIGS. 1 and 2 as conical ice collar 26. The conical ice collar 26 has sloping outer surfaces 31 and 33 to encounter moving sheet ice. When the sheet ice encounters either a sloping surface 31 or 33 of the conical ice collar 26, it is deflected either upwardly or downwardly which causes the sheet ice to break into smaller pieces due to the ensuing bending stresses in the ice. The size and location of the conical ice collar 26 will depend on the magnitude of the ice-loads likely to be encountered at the relevant site. The conical ice collar 26 may also be useful to mitigate or eliminate ice-induced structural vibrations resulting in the offshore structure 10. The conical ice collar 26 will not be necessary for applications in non-ice environments.

The offshore structure 10 can be a single unitary structure, or fabricated in several pieces. Thus the upper section 22 and the lower foundation section 20 can be separate units that are mechanically 6 or structurally connected prior to installation. The conical ice collar 26 can also be a separate unit or part of a single unitary structure. Generally, a single piece fabrication may be more desirable because it eliminates the use of a mechanical connector. The offshore structure 10 can be formed of concrete, steel, a composite material or any other suitable material as will be well known to those skilled in the art. Depending on the application needed, the offshore structure 10 should be sized to house a plurality of well conductors, risers, j-tubes and the like, to support gravity loads from a deck, and to resist design forces from waves, sea ice, and/or earthquakes. The upper section 22 of the offshore structure 10 should be made large enough to house the desired number of well conductors, risers, j-tubes and the like. However, near the seafloor 18, the upper section 22 diameter may, depending on the proposed application, require enlargement (as illustrated in FIG. 2 by the tapered transition section 27 of the upper section 22) to be able to resist the design ice-induced base moment. The lower foundation section 20 embedded in the seabed 21 needs to be sufficiently large in diameter and length to develop adequate lateral and vertical soil resistance against global ice loading. Thus, the offshore structure 10 can also be sized for a specified embodiment such that the lower foundation section 20 has a larger cross-sectional diameter than the cross-sectional diameter of the upper section 22.

Figure 3A:
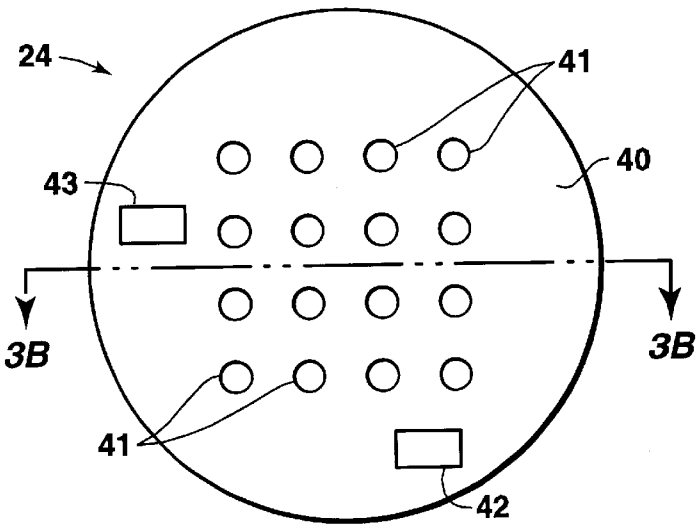
FIGS. 3(*a*) and 3(*b*) show a structural diaphragm in accordance with the present invention illustrated in a plan view (a) and a cross-sectional view (b).
Figure 3B:
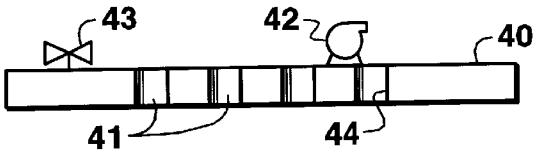

One example application for the offshore structure 10 is a combined drilling/wellhead platform development offshore in fifteen to thirty-Five meters of water. With ten well conductors in the offshore structure 10, a ten meter diameter for the upper section 22 of the offshore structure 10 has been estimated. The offshore structure 10 would be equipped with a conical ice collar 26 to mitigate the ice loads. The diameter of the upper section 22 near the seafloor 18 and the lower foundation section 20 penetrating into the seabed 21 may vary from twenty to twenty-Five meters depending on the water depth at the installation site. For this particular example, depth of penetration into the seabed 21 may be thirty meters. Inside the offshore structure 10, there will be a structural diaphragm 24 that separates the lower foundation section 20 from the upper section 22. Basically, structural diaphragm 24 (as shown in FIGS. 3A and 3B) is a solid partition 40 that is oriented substantially perpendicular to the longitudinal axis of offshore structure 10 and that serves as a septum or partition between lower foundation section 20 and upper foundation section 22. When installed, the structural diaphragm 24 rests on the seafloor 18 and enhances the vertical and lateral load-carrying capacity of the offshore structure 10.

To install the offshore structure 10, the assembled structure 10 or its individual components will be delivered to the field either by a barge or will be towed as a self-floater. With the aid of a jack-up rig or a crane barge, the offshore structure 10 will be set on the seafloor 18 in an upright position. Initially through self-weight and subsequently with the aid of under pressure (suction) and possibly water jets 8, as described further below, the lower foundation section 20 of the offshore structure 10 will penetrate into the seabed 21 until the structural diaphragm 24 rests on the seafloor 18.

One embodiment of the structural diaphragm 24 is illustrated in FIG. 3A (with a cross-sectional view illustrated in FIG. 3B) and consists of a water-tight solid partition 40 having at least one valve 43 for allowing fluid to flow between the upper section 22 and the lower foundation section 20 of the offshore structure 10. Well conductor guide sleeves 41 are embedded in the partition 40 and are filled with grout 44 until the installation of the offshore structure 10 is complete, at which time the grout 44 in the guide sleeves 41 can be drilled out and conductors can be installed.

When the offshore structure 10 is upended to a vertical position and lowered to the seafloor 18, valve 43 is open so that water will evacuate the lower foundation section 20. The lower foundation section 20 will be able to initially penetrate the seabed 21 because of the weight of the offshore structure 10 itself. The valve 43 is closed, and the structural diaphragm 24 is adapted to allow a pump 42 (which may be an underwater pump, depending on the water depth) to pump fluid out of the lower foundation section 20. When the pump 42 is operated, fluid is removed from the lower foundation section 20, thereby creating under pressure or suction beneath the structural diaphragm 24. By removing fluid from the lower foundation section 20 the pressure below the structural diaphragm 24 is lowered, thereby forming a pressure gradient across the structural diaphragm 24 and reducing the effective stresses, and hence the soil strength, inside and at the tip 25 of the lower foundation section 20. This pressure gradient creates a downward driving force across the structural diaphragm 24. The combination of the driving force from the weight of the offshore structure 10, the driving force from the activation of the pump 42, and the reduced soil strength allow the lower foundation section 20 to penetrate the seabed 18 until the structural diaphragm 24 rests on the seafloor 18. After complete penetration, value 43 remains closed to prevent further movement of water between lower foundation section 20 and upper section 22.

The effectiveness of the suction will depend on the specific characteristics of the soil (i.e., how easily the soil will drain to achieve the desired underpressure). The available driving force (from the weight of the offshore structure 10) will determine in the first place how much underpressure will be needed to penetrate the offshore structure 10 to its target depth. In addition, the side and end friction of the lower foundation section 20 walls in contact with the soil will have a bearing on the effectiveness of the suction. To further facilitate installation, the lower foundation section 20 can be fitted with high pressure jets 8 at the tip 25 of the lower foundation section 20. The jets 8 are used to spray fluidly at a high pressure into the soil around the tip in order to reduce or eliminate tip resistance and reduce skin friction resistance, thereby further facilitating installation.

Given the particular soil and the geometry of the offshore structure 10, installation can be achieved if, as described further below: (1) excessive flow or piping of water does not occur; (2) the soil does not become quick; (3) and the under pressure does not exceed the cavitation pressure inside the lower foundation section 20. When operating the pump 42, a hydrostatic gradient will be created in the soil located in the lower foundation section 20. As water moves up through the soil, there may also be some soil that moves Up. The flow of water will need to be restricted to ensure the soil does not become "quick"(i.e., like quicksand) and to keep from producing, soil up through the pump 42. If the foundation sand becomes quick, it is liquefying: the sand completely loses its strength and therefore is not capable of providing support to the offshore structure 10.

Once installed, the offshore structure 10 is ready to receive the drilling rig and equipment, which can be delivered to the site either by a integrated deck and transport system, ajack-up deck transporter, or lifted by a crane barge. The best mode of application of the offshore structure 10 is for a specific water depth in the range of 10–40 meters, in combination with an integrated deck and transport system as to disclosed in co-pending patent application entitled "Deck Installation System for Offshore Structures", identified by applicants U.S. patent application Ser. No. 09/409,044. The integrated deck and transport system provides the means by which either a drilling deck or a wellhead production deck can be installed on top of the offshore structure 10. After deck installation, the pontoons of the apparatus are either retracted from the sea to the deck level or are entirely removed from the deck structure assembly. Alternatively, a transporter specifically dedicated to transporting and installing drilling and production decks can install the deck. Such a transporter is disclosed in U.S. Pat. No. 4,648,751, which is fully incorporated herein by reference for purposes of U.S. patent practice.

The offshore structure 10 of the present invention solves the high cost of exploration drilling experienced with the drilling systems previously discussed by providing a low-cost drilling deck support structure. Once installed at a specific location, the off short structure 10 has the capacity to resist the environmental forces on a year-round basis. The offshore structure 10 can be used at its location at no additional cost as long as drilling activities need to be carried out. Once drilling is completed, the offshore structure 10 can be used to support wellhead production activities. Because of its low capital and installation costs, the economics of drilling with the use of the offshore structure 10 are not dependent on redeployment of the caisson. If the site is to be abandoned, the offshore structure 10 can be removed by reversing, the installation process or by severing the offshore structure 10 at or near the muddline, and the steel content can be salvaged at little or no risk to the environment.

Inasmuch as the present invention is subject to many variations, modifications and changes in detail, it is intended that all subject matter discussed above or shown in the accompanying drawings be interpreted as illustrative and not in a limiting sense. Such modifications and variations are included in the scope of this invention as defined by the following claims.

We claim:

1. An offshore structure for use in a body of water having a surface and a seafloor, said offshore structure comprising a tubular caisson structure having a lower foundation section and an upper section separated by a structural diaphragm, said lower foundation section extending downwardly from said seafloor into the seabed a distance to provide sufficient lateral and vertical soil resistance to resist lateral and vertical loads on said offshore structure, said upper section extending upwardly from said seafloor to a point above the surface of said body of water and adapted to support a deck structure on the upper end thereof, said structural diaphragm adapted to rest on the seafloor when said offshore structure has been fully installed to enhance the lateral and vertical load carrying capacity of said tubular caisson structure and wherein said structural diaphragm is a solid partition having at least one valve for allowing fluid to flow between said upper section and said lower foundation section of said tubular caisson structure and having a pump for forming suction in said lower foundation section of said tubular caisson structure.

2. The offshore structure of claim 1 wherein said pump is adapted to pump fluid out of said lower foundation section of said tubular caisson structure.

3. The offshore structure of claim 1 wherein said upper section of said tubular caisson structure further comprises an ice resistor.

4. The offshore structure of claim 1 wherein said tubular caisson structure is sized to house a plurality of well conductors.

5. The offshore structure of claim 1 wherein said tubular caisson structure is formed of steel.

6. The offshore structure of claim 1 wherein said tubular caisson structure is formed of concrete.

7. The offshore structure of claim 1 wherein said tubular caisson structure is formed of a composite material.

8. The offshore structure of claim 1 wherein said lower foundation section of said tubular caisson has a larger cross-sectional diameter than the cross-sectional diameter of said upper section of said tubular caisson structure.

9. The offshore structure of claim 1 wherein said tubular caisson structure is a unitary structure.

10. The offshore structure of claim 1 wherein said tubular caisson structure further comprises jets attached to the lower foundation section of said tubular caisson structure, said jets adapted to facilitate installation of said tubular caisson structure.

11. The offshore structure of claim 1 wherein said upper section and said lower foundation section of said tubular caisson structure are separate units that are mechanically connected.

12. An offshore structure for use in a body of water having a surface and a seafloor, said offshore structure comprising a tubular caisson structure having a lower foundation section and an upper section separated by a structural diaphragm, said lower foundation section extending downwardly from said seafloor into the seabed a distance to provide sufficient lateral and vertical soil resistance to resist lateral and vertical loads on said offshore structure, said upper section extending upwardly from said seafloor to a point above the surface of said body of water and adapted to support a deck structure on the upper end thereof, said structural diaphragm adapted to rest on the seafloor when said offshore structure has been fully installed to enhance the lateral and vertical load carrying capacity of said tubular caisson structure; and said offshore structure further having means for creating suction in said lower foundation section during installation of said off shore structure to assist said tubular caisson structure in penetrating into said seafloor.

13. The offshore structure of claim 12 wherein said structural diaphragm is a solid partition having at least one valve for allowing fluid to flow between said upper section and said lower foundation section of said tubular caisson structure, and having a pump which is adapted to pump fluid out of said lower foundation section of said tubular caisson structure and thereby form said suction in said lower foundation section.

14. The offshore structure of claim 12 wherein said upper section of said tubular caisson structure further comprises an ice resistor.

15. The offshore structure of claim 12 wherein said tubular caisson structure is sized to house a plurality of well conductors.

16. The offshore structure of claim 12 wherein said tubular caisson structure is formed of steel.

17. The offshore structure of claim 12 wherein said tubular caisson structure is formed of concrete.

18. The offshore structure of claim 12 wherein said tubular caisson structure is formed of a composite material.

19. The offshore structure of claim 12 wherein said lower foundation section of said tubular caisson has a larger cross-sectional diameter than the cross-sectional diameter of said upper section of said tubular caisson structure.

20. The offshore structure of claim 12 wherein said tubular caisson structure is a unitary structure.

21. The offshore structure of claim 12 wherein said upper section and said lower foundation section of said tubular caisson structure are separate units that are mechanically connected.

22. The offshore structure of claim 12 wherein said tubular caisson structure further comprises jets attached to the lower foundation section of said tubular caisson structure, said jets adapted to facilitate installation of said tubular caisson structure.

23. A method for installing, an offshore structure into the seafloor, said offshore structure comprising a tubular caisson structure having a lower foundation section and an upper section separated by a structural diaphragm, said method comprising, the steps of:

(a) inserting said tubular caisson structure into the seafloor and allowing the lower foundation section to penetrate the seafloor under self-weight;

(b) creating suction beneath said structural diaphragm, whereby said lower foundation section penetrates the seafloor until said structural diaphragm rests on the seafloor and said lower foundation section extends downwardly from the seafloor into the seabed and said upper section extends upwardly from the seafloor.

24. The method of claim 23 wherein said structural diaphragm is adapted to pump fluid out of said lower foundation section.

25. The method of claim 24 wherein said structural diaphragm is a solid partition having at least one valve for allowing fluid to flow between said upper section and said lower foundation section of said tubular caisson structure and having a pump which is adapted to pump fluid out of said lower foundation section.

26. The method of claim 23 wherein said lower foundation section further comprises jets, said jets adapted to spray fluid at a high pressure into the soil around the tip of the lower foundation section, thereby facilitating installation.

* * * * *